United States Patent [19]

Boman

[11] 3,934,629

[45] Jan. 27, 1976

[54] SCREW DRIVER

[75] Inventor: Carl-Edvard F:son Boman, Nacka, Sweden

[73] Assignee: Atlas Copco Aktiebolag, Nacka, Sweden

[22] Filed: Dec. 23, 1974

[21] Appl. No.: 535,684

[30] Foreign Application Priority Data

Jan. 15, 1974 Sweden ..... 7400513

[52] U.S. Cl. ..... 144/32; 144/32

[51] Int. Cl.[2] ..... B25B 21/00

[58] Field of Search ..... 29/240; 81/52.4 A; 10/135 R; 144/32; 192/48.1; 408/139

[56] References Cited

UNITED STATES PATENTS

| | | | |
|---|---|---|---|
| 2,790,471 | 4/1957 | Graybill | 144/32 |
| 2,886,075 | 5/1959 | Skoog | 144/32 |
| 3,146,811 | 9/1964 | Shryock | 144/32 |
| 3,174,599 | 3/1965 | Spyridakis | 408/139 X |

*Primary Examiner*—Al Lawrence Smith
*Assistant Examiner*—Gary L. Smith
*Attorney, Agent, or Firm*—Flynn & Frishauf

[57] ABSTRACT

A screw driver comprising a torque responsive clutch for determining the final tightening torque and an output spindle connected to a forwardly extending screw bit. The spindle is axially displaceable from a forward rest position to an intermediate tightening position and a rear position in which dogs on the spindle engage dogs on the driving part of the clutch for inactivation of the clutch. The spindle, which is spring-biased toward its normal tightening and rest positions, is permitted to reoccupy its normal tightening position during the final tightening sequence in that a stud element on the screw driver housing is arranged to abut against the screw landing surface, thereby automatically preventing the screw driver housing and the clutch from following the spindle and screw bit to their final positions and ensuring reactivation of the clutch.

17 Claims, 6 Drawing Figures

SCREW DRIVER

This invention relates to a screw driver, for thread forming screws in particular, comprising a motor which rotates an output spindle through a power transmission including a torque limiting device for determining the final tightening torque.

SUMMARY OF THE INVENTION

The invention is generally characterized by an operator-controlled device for inactivation of the torque limiting device and thereby permitting the output torque to exceed the desired final tightening torque. Also provided is a position responsive sensing means for reactivating the torque limiting device when it had been previously manually deactivated.

DETAILED DESCRIPTION

Figure 1A:
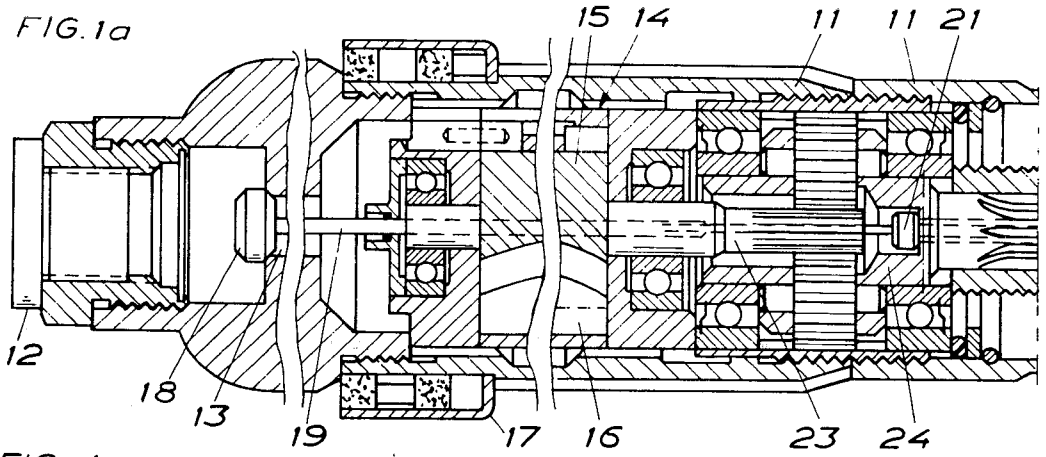
FIG. 1*a* and FIG. 1*b* are intended to be regarded together, FIG. 1*a* showing the rear end and FIG. 1*b* showing the forward end of a screw driver according to the invention.

The screw driver, shown in the figures, comprises a housing 11 which is provided with a threaded connection 12 for a non-illustrated pressure air hose, and a supply passage 13 for a sliding vane motor 14. The motor comprises a rotor 15 which is provided with axial slots for vanes 16. The outlet passages of the motor are connected to a silencer 17. The supply passage 13 is controlled by a valve body 18 which is connected to a valve rod 19. The latter extends through an axial bore in the rotor 15 and is jointed at 21. The forward end of the rod has been denoted 22. The driving axle 23 of the rotor constitutes the sun wheel in a planetary gear arrangement, the planet wheel carrier 24 of which is connected to a sleeve 26 by means of a spline joint 25 therebetween.

The sleeve 26 is rigidly connected to an inner sleeve 27 by means of a pin 28 which is press fit to sleeves 26, 27. The rear part of the outer sleeve 26 is threaded and carries a nut 29. From a shoulder 30, the forward part of the sleeve 26 is cylindrical and a sleeve 31, hereinafter called the intermediate sleeve, is axially and rotatably movable on this cylindrical part. Axial splines 32 extend rearwardly from the shoulder up to pin 28. A ring 33 which is provided with internal splines mating with the splines 32 of the sleeve 26 is axially movable along the sleeve 26.

Another ring 34 constitutes an axial thrust bearing together with balls 35 and a flange 36 on the sleeve 27. The sleeve 31 and the ring 34 are provided with cooperating recesses 37, 38 (FIG. 5) for retaining rollers 39 and constituting a torque limiting clutch. The sleeve 31 is provided with other recesses 40 which cooperate with recesses 41 in the ring 33 for retaining rollers 42 and constituting a second torque limiting clutch. A spring 43 reacts against the nut 29 and forces the ring 33 forward. The axial force is transferred via the rollers 42, the intermediate sleeve 31 and the rollers 39 to the ring 34 of the axial thrust bearing. Two sleeve shaped securing plates 44, 45 retain the rollers 39, 42 in the radial position.

Figure 5:
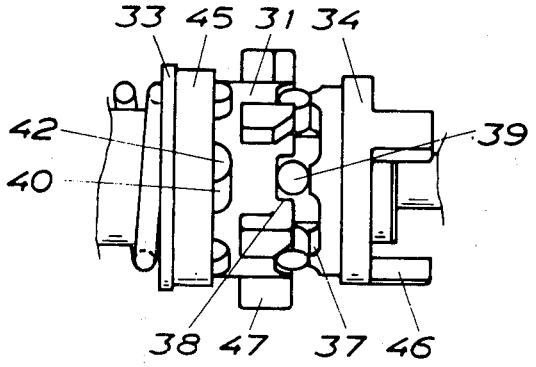
FIG. 5 shows a fragmentary view of some of the details shown in FIG. 1*b*.

At overload, the rollers 39 tend to roll up from the recesses 37 and urge the intermediate sleeve 31 to move axially rearwardly, as shown in FIG. 5. Thus, the clutch 31, 39, 34 slips when being loaded by a torque exceeding a torque which is determined by the preload of the spring 43. The preload of the spring 43 can be adjusted by turning the nut 29 which is accessible through openings in the housing 11. The clutch constituted by the intermediate sleeve 31, the rollers 42 and the ring 33 is designed so as not to start slipping until it is loaded by a considerably higher torque, for instance a torque which is twice as heavy as the torque at which the low torque clutch 31, 39, 34 starts slipping. By means of the nut 29 the release torques of both clutches are set simultaneously and the relationship between their torque limits is maintained during adjustment. The ring 34 which forms the axial thrust bearing has three forward directed dogs 46 and the intermediate sleeve 31 has six dogs 47 (FIG. 1 b and 5).

A support sleeve 50 is threaded onto the forward end of the housing 11 and is locked by means of a lock nut 51. When running down a screw the sleeve 50 acts as a stud member by which the screw driver housing 11 is supported on the screw bed during the final tigthening of the screw.

Within the support sleeve 50 there is slidably arranged a guiding sleeve 52 which, by a weak spring 53, is forced forwardly against a shoulder in the support sleeve. The screw driver further comprises a driving spindle 55 which is rotatably journalled in housing 11. A bit 54 for cross-recessed screws, having a hexagonal neck, is non-rotatably introduced in the driving spindle and is axially locked therein by means of a lock ball 56. A central body 57 extends into the driving spindle 55 and rests against a shoulder 58 therein. The central body 57 extends rearwardly into the sleeve 27 and is loaded forwardly by a spring 59 situated within this sleeve. The spring 59 is supported in the sleeve 27 and acts upon the body 57 via a ball 60. Thus, the spring 59 pushes the driving spindle 55 toward a forward end position (shown in FIG. 1 b) via the ball 60 and the body 57. In this position the driving spindle 55 abuts against a bushing 61 which is fixedly mounted in the housing 11 by means of press fit and locking liquid. The body 57 is provided with a waist in which there is lodged a spring ring 62 which provides an abutment shoulder for a stop sleeve 63. The latter is pressed against the spring ring 62 by a compression spring 65 which acts upon the stop sleeve 63 and the driving spindle 55. The driving spindle 55 has three rearwardly directed dogs 64 for cooperation with the dogs 46 as well as the dogs 47 of the intermediate ring 31.

The operation of the screw driver is the following

Figure 1B:
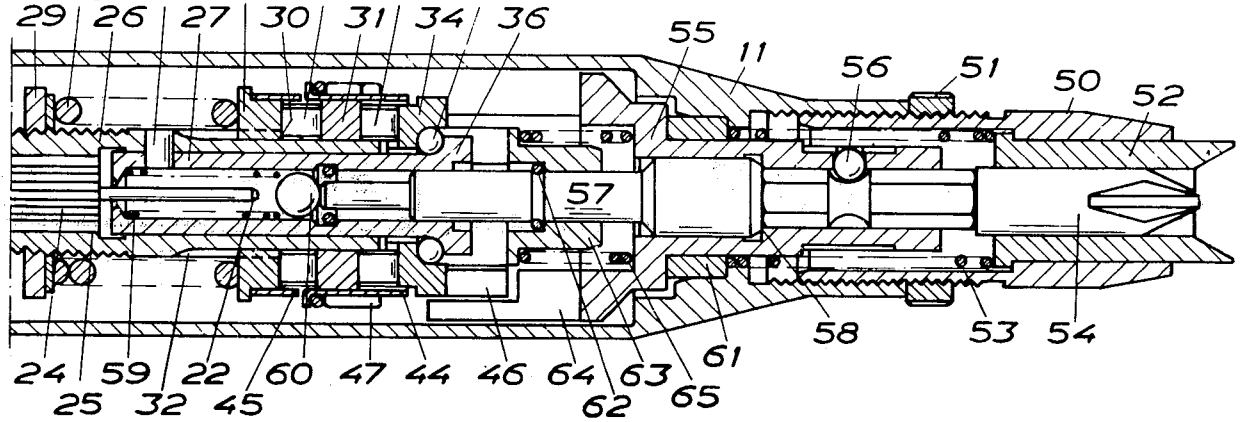
Figure 2:
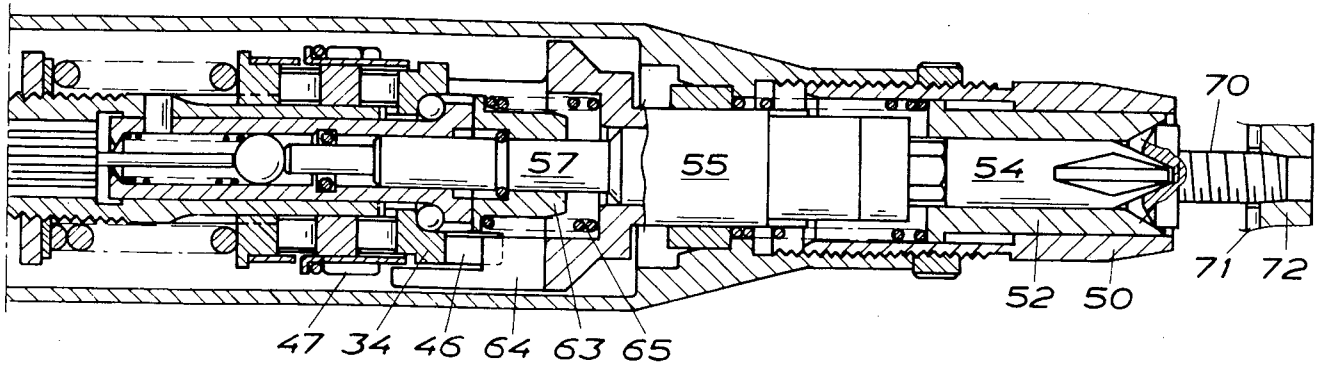
FIGS. 2 and 3 correspond to FIG. 1*b* but show the parts of the screw driver in different relative positions.
Figure 3:
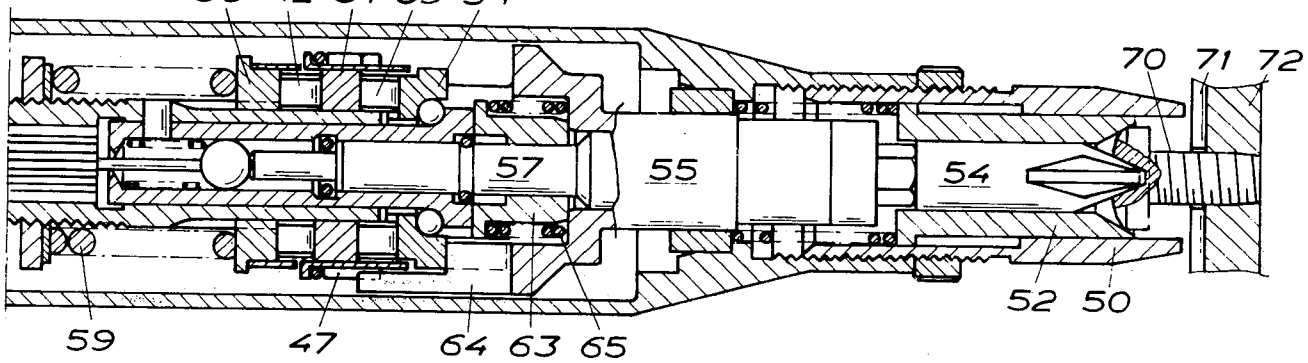
Figure 4:
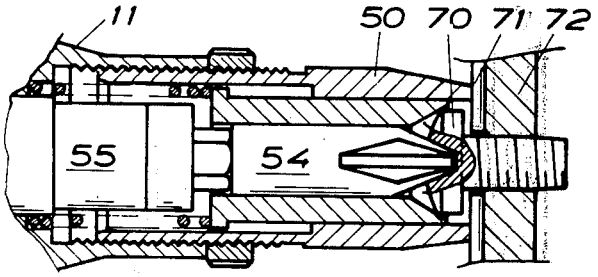
FIG. 4 corresponds to the forward end of FIG. 1*b* but with some parts in still another position.

In FIG. 1*a* and FIG. 1*b* the screw driver is shown in rest position and in FIG. 2, 3 and 4 the screw driver is shown in engagement with a screw 70. The screw 70 is a thread forming screw for connecting a piece of thin sheet metal 71 to a piece of thicker sheet metal 72. The screw itself is intended to form the threads in the thicker sheet 72. When the screw driver is pressed against the screw 70 the guiding sleeve 52 will spring rearwardly simultaneously as it guides the bit 54 down onto the screw head. At maintained moderate feeding pressure the bit will push the driving spindle 55 and the body 57 backwardly so that the dogs 64 of the driving spindle engages the dogs 46 of the ring 34, as shown in FIG. 2. Now, the two clutches 33, 42, 31 and 31, 39, 34 are connected in series for transferring a torque. The operator feels a distinct stop position when the stop sleeve 63, which is loaded by the comparatively strong spring 65, gets into axial contact with the end surface of the sleeve 27. Thereupon, the ball 60 has moved the valve rod 19 rearwardly so that the valve body 18 has disengaged its seat, and motive air is supplied to the motor.

Now, the screw driver runs down the screw 70 till the latter lands and the torque, because of that, increases to the torque limit which causes slipping of the low torque clutch 31, 39, 34. Thereupon, the operator lifts the nut runner and the spindle 55, the body 57 and the sleeve 63 return to their rest positions, as shown in FIG. 1*a* and 1.

Particularly, at tightening thread forming screws (as shown in the figures) a higher torque could be needed during the thread forming sequence than what is desired to be the final tightening torque. If the screw tends to get jammed during running down, the operator can increase his feeding force so that the preloaded spring 65 is contracted and the spindle is pushed back into a rear position, as shown in FIG. 3. For instance, to be compressed, the spring 65 may require an axial force which is about three times that of the spring 59. Then, the dogs 64 of the driving spindle 55 come into engagement with the dogs 47 of the intermediate sleeve 31 and lock the low torque clutch 31, 39, 34 against slipping. However, the high torque clutch 33, 42, 31 is free to slip if being overloaded. For avoiding the screw to be overtightened, e.g. tightened to a higher torque than what is desired, the support sleeve 50 is set, before using the screw driver, in such an extended position that it will abut against the surface of the sheet 71 before the screw is completely run down, as shown in FIG. 4. Thereby, independently of the magnitude of the feeding force applied by the operator, the drive spindle 55 is permitted to move forward so that the dogs 64 of the driving spindle lose their engagement with the dogs 67 of the intermediate sleeve 31 before the screw lands. Thereby, the low torque clutch 31, 39, 34 is always free to slip as the predetermined final tightening torque is reached and the screw is automatically protected from being overtightened.

What I claim is:

1. Screw driver for driving a screw into a screw bed, comprising:

a housing (11), a motor (14) located in said housing, a power transmission and an output spindle (54,55) coupled to said motor, said power transmission including a torque limiting device (31, 39, 34) which comprises a driving member and a driven member, said driving and driven members having means to slip relative to each other as a predetermined torque magnitude is reached;

locking means (47, 64, 54, 55) coupled to said torque limiting device and manually shiftable between a first, normal tightening position and a second, high torque level position in which said locking means interlocks said driving member and said driven member of said torque limiting device against relative slipping, and means (50) coupled to said locking means for sensing the actual, axial position of the screw by engaging the screw bed, and means connected to said sensing means (50) for shifting said locking means from said second high torque level position toward said first, normal tightening position responsive to the screw reaching a predetermined axial position relative to said screw bed to thereby reactivate said torque limiting device.

2. Screw driver according to claim 1 wherein:

said locking means (47, 64, 54, 55) includes said output spindle (55), said output spindle being axially displaceable between a normal tightening position and a rear position in which it is arranged to cause inactivation of the torque limiting device, means being provided to load said output spindle (55) toward said normal tightening position, and said screw position sensing means comprises a stud member (50) rigidly connected to said housing (11), said stud member (50) being arranged to abut against the screw bed and support said housing (11) on said screw bed before the screw has reached its final position, thereby enabling said output spindle (55) to occupy its normal tightening position and ensure shifting of said torque limiting device to reactivate said torque limiting device.

3. Screw driver according to claim 2, wherein said torque limiting device comprises a first torque responsive clutch (31, 39, 34) and said output spindle (55) is provided with means (64) for cooperation with the driving part (31) of said torque responsive clutch (31, 39, 34).

4. Screw driver according to claim 3, wherein said clutch comprises a ratchet clutch (31, 39, 34) and a spring (43) for preloading said ratchet clutch.

5. Screw driver according to claim 4, wherein said clutch includes adjustable means (29) for preloading said spring (43).

6. Screw driver according to claim 3, wherein said torque limiting device includes a second torque responsive clutch (31, 39, 34) connected in series with said first torque responsive clutch (31, 39, 34), said second torque responsive clutch (33, 42, 31) being arranged to release at a higher torque than said first torque responsive clutch (31, 39, 34).

7. Screw driver according to claim 6, wherein both of said torque responsive clutches comprise respective ratchet clutches.

8. Screw driver according to claim 7, wherein said torque limiting device includes a common pre-stressed spring (43) for loading both of said ratchet clutches (31, 39, 34, and 33, 42, 31), and adjustable means (29) against which said common spring (43) is arranged to react, the prestress of said common spring (43) being set by adjustment of the position of said adjustment means (29).

9. Screw driver according to claim 2, wherein said locking means includes means for preloading said spindle (54, 55) of said locking means forwardly in two steps, a first step being between a forward rest position and said normal tightening position and a second, heavier preloaded step being between said normal tightening position and said rear position, said screw driver further including a supply valve (18) coupled to said motor, said spindle (54, 55) being connected to said supply valve (18) to keep said supply valve in an open position when said spindle is in said normal tightening position as well as in said rear position.

10. Screw driver according to claim 2, wherein said screw position sensing means includes a spindle surrounding sleeve (50) which is axially adjustable relative to said housing (11).

11. Screw driver according to claim 10, further comprising a spring biased screw guiding sleeve (52) disposed between said spindle surrounding sleeve (50) and said spindle (54, 55) of said locking means, and a spring (53) biasing said screw guiding sleeve (52) in the forward direction.

12. Screw driver according to claim 2, wherein said locking means includes means for preloading said spindle (54, 55) of said locking means forwardly in two steps, a first step being between a forward rest position and said normal tightening position and a second, heavier preloaded step being between said normal tightening position and said rear position, and a further clutch (46, 64), which is controlled in response to the position of said spindle (54, 55), for keeping said spindle (54, 55) released in said rest position but connected to said power transmission in said normal tightening position.

13. Screw driver according to claim 1, wherein said torque limiting device includes a first over-load release clutch (31, 39, 34), and a second over-load release clutch (33, 42, 31) connected in series with said first over-load release clutch.

14. Screw driver according to claim 13, wherein said locking means includes a common spring (43) for loading both of said overload release clutches (31, 39, 34 and 33, 42, 31), whereby the release torques of said over-load release clutches can be set simultaneously.

15. Screw driver according to claim 3 wherein said first torque responsive clutch is a lockable clutch.

16. Screw driver according to claim 6 wherein said first torque responsive clutch is a lockable clutch.

17. Screw driver according to claim 13 wherein said first over-load release clutch (31, 39 34) is a lockable clutch.

* * * * *